US008448271B2

(12) United States Patent
Rudisser

(10) Patent No.: US 8,448,271 B2
(45) Date of Patent: May 28, 2013

(54) FAUCET CONTROLLED IN A CONTACTLESS MANNER

(75) Inventor: Martin Rudisser, Jona (CH)

(73) Assignee: Geberit International AG, Jona (CH)

( * ) Notice: Subject to any disclaimer, the term of this patent is extended or adjusted under 35 U.S.C. 154(b) by 687 days.

(21) Appl. No.: 12/565,183

(22) Filed: Sep. 23, 2009

(65) Prior Publication Data

US 2010/0071126 A1 Mar. 25, 2010

(30) Foreign Application Priority Data

Sep. 24, 2008 (EP) ..... 08405236

(51) Int. Cl.
*E03C 1/05* (2006.01)

(52) U.S. Cl.
USPC ..... 4/623

(58) Field of Classification Search
USPC ..... 4/623, 668; 251/128, 129.03, 129.04; 137/801
See application file for complete search history.

(56) References Cited

U.S. PATENT DOCUMENTS

| | | | | |
|---|---|---|---|---|
| 5,586,746 | A | 12/1996 | Humpert et al. | |
| 5,720,316 | A | 2/1998 | Simotti | |
| 7,445,024 | B2 * | 11/2008 | Paterson et al. | 137/606 |
| 7,862,001 | B2 * | 1/2011 | Maercovich et al. | 251/40 |
| 2007/0108400 | A1 * | 5/2007 | Johnson et al. | 251/129.04 |

FOREIGN PATENT DOCUMENTS

| | | | |
|---|---|---|---|
| EP | 0 391 765 | A1 | 10/1990 |
| EP | 0 688 909 | A1 | 12/1995 |
| EP | 0 701 028 | A1 | 3/1996 |
| EP | 1 785 531 | A2 | 5/2007 |
| WO | 2007/122476 | A1 | 11/2007 |

* cited by examiner

*Primary Examiner* — Gregory Huson
*Assistant Examiner* — Christine Skubinna
(74) *Attorney, Agent, or Firm* — Sughrue Mion, PLLC

(57) ABSTRACT

The faucet has a fitting body, which has a base (2) that is securable to a wash-stand or a building wall and a housing (3) that is detachably mounted on said base. The housing (3) has a housing (3) that has an outlet member (4) and a water outlet opening (5). An electrically operated valve (6) and a presence detector (7) are mounted on the base (2). The presence detector (7) is mounted in a receiving space (18) of the housing (3) on a holder (8) that has electric contacts (30, 31). The holder (8) is positioned so as to be mechanically and electrically detachable on a contact carrier (58) that is secured to the base (2) and has electric contacts (34, 35).

14 Claims, 3 Drawing Sheets

FAUCET CONTROLLED IN A CONTACTLESS MANNER

Figure 2:
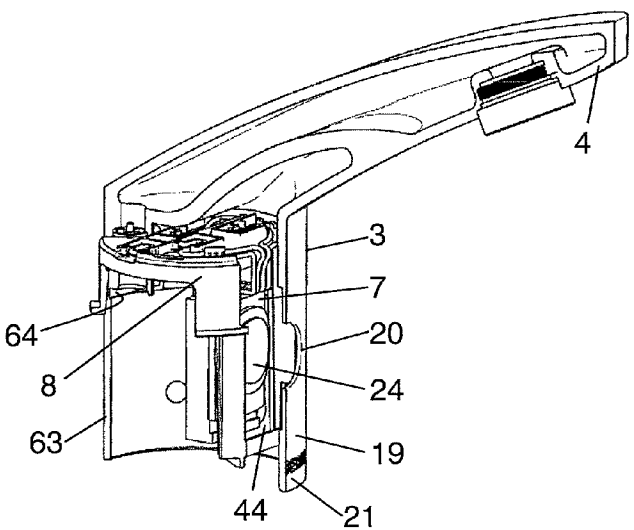

The invention relates to a faucet controlled in a contactless manner, said faucet having a fitting body, which has a base that is securable to a wash-stand or a building wall and a housing that is detachably mounted on said base and has an outlet member with a water outlet opening, an electrically operated valve mounted on the base and a presence detector.

Such faucets have been known for a long time. The presence detector has, for example, an infrared sensor that is positioned such that it can establish the presence of an object, in particular a hand, in a predetermined region. Once a presence has been detected, the valve is opened by means of a control means via a signal. Water then flows into the housing and to the water outlet opening. A battery is mounted in the faucet body for supplying power, or the power is supplied through a connection to a network. The housing is removable, thereby enabling an inspection.

A faucet of the named type has been made known by the applicant in EP-A-1 785 531. In the case of said faucet, the presence detector is mounted on a window housing member (230) that is secured to the base by means of two screws. The housing is connected to the base by means of another screw. Once said screw has been released, the housing can be removed from the base. The presence detector, in this case, remains on the base. The presence detector is connected electrically to the valve by means of connecting cabling. Said cables can be separated at a plug-in contact. The sealing of said window housing member relative to the housing and to the base is comparatively expensive and time-consuming. An automatic valve protection system through contact breaking is necessary so that the housing can be removed. This is effected, in this case, by undoing the screw with which the housing is connected to the base.

EP-A-0 688 909 discloses a faucet where a battery, the presence detector and a control means are mounted in an insert member. The insert member is inserted into a recess of the base and is secured therein by means of a screw. The presence detector or the control means are connected to the valve by means of a connecting cable, said valve, in this case, also being mounted on the base. Once the said screw has been released, the insert member can be removed from the recess of the base. The insert member can be released from the valve by means of a plug-in connection. An inspection is comparatively expensive and time-consuming as the housing cannot be removed from the base until the named screw is released, the insert member removed and the plug-in connection of the cable broken. In the case of the faucet according to EP-A-0 921 238, an insert member is also provided, however this one is inserted from below into a recess of the base.

It is the object of the invention to create a faucet of the named type that avoids the named disadvantages. In particular, the mounting, the servicing and the sealing are to be simpler.

The object is achieved according to Claim 1 in that the presence detector is mounted in a receiving space of the housing on a holder that has electrical contacts and the holder is positioned so as to be mechanically and electrically detachable on a contact carrier that is secured to the base and has electrical contacts. In the case of the faucet according to the invention, the presence detector is consequently not mounted on the base but on a holder in the housing, said holder having electrical contacts. A contact carrier that also has electric contacts is positioned on the base. If the housing is separated from the base, the electric contacts between the holder and the contact carrier are automatically broken. On account of said contact separation, the valve is immediately automatically closed. Cabling does not have to be interrupted. After an inspection, the housing can very easily be placed back in position onto the base and, for example, secured by means of a screw. The electrical contacts between the holder and the contact carrier can be produced purely by means of the placing in position. Consequently, separate cables do not have to be interconnected. The sealing is considerably simpler as purely just the window of the presence detector has to be sealed off from the housing. This can be effected, for example, using a simple ring seal. The power supply can be provided by a battery that is mounted on the base. A connection to a supply network is also possible.

According to a further development of the invention, it is provided that the holder has a plate on which the electric contacts are positioned, and that the plate has an underside, on which said contacts are electrically connected to the contacts of the contact carrier. Said plate can be approximately circular, for example, and inserted into the receiving space of the housing. Such a plate can be locked in the housing in a comparatively simple manner, for example, by means of spring arms. The holder preferably has two contacts for the contacting of an energy source and two contacts for controlling the valve.

According to a further development of the invention, it is provided that the holder has an opening into which the presence detector is inserted from the receiving space radially outwards. During assembly, the holder with the presence detector is inserted into the receiving space of the housing. By means of a movement directed radially outwards, the presence detector is then inserted into the named opening of the holder. The presence detector is then positioned in the housing. In this case, the presence detector is preferably locked in the named opening of the holder. To this end, according to a further development of the invention, it is provided that locking means, for example, locking ribs are positioned in the opening on the holder.

According to a further development of the invention, it is provided that the presence detector is connected in a displaceable manner to the contacts of the holder by means of connecting cabling. The presence detector is then consequently non-detachably connected to the holder, but can be displaced radially to be inserted into the named opening of the holder. Correspondingly then, for an inspection, the presence detector can be removed from the opening by means of a radially inwardly directed movement, but it still remains connected to the holder by means of the connecting cable.

Simple contacting is produced, according to a further development of the invention, by the electric contacts of the contact carrier being formed by spring-resilient elements, which are each tensioned against a contact of the holder. Said elements can be realized in a particularly simple and nevertheless secure manner by means of springs, for example spiral springs. When the housing is placed in position, said springs are tensioned. This produces a secure electrical contact that is immediately broken when the housing is removed.

According to a further development of the invention, it is provided that the contact carrier comprises two members, wherein the one member is connected electrically to the valve and the other member is connected electrically to the energy source or the supply network. Such a contact carrier can be produced in a particularly simple manner. The electric contacts are also easily producible. Both members are preferably detachably secured, for example screw-connected, on the base.

According to a further development of the invention, it is provided that contact carrier engages from below in the receiving space of the housing and supports the presence detector in said receiving space, securing it in the provided position. This produces a particularly simple and nevertheless secure fixing of the presence detector in the housing. Wedges or the like for securing the presence detector are not necessary. When the housing is placed in position onto the base, this automatically causes the presence detector to be secured by the named contact carrier. When the housing is removed from the base, the presence detector is then correspondingly detachable again from the holder or from the housing.

The securing of the presence detector is effected according to a further development of the invention by means of a wall that is offset somewhat radially inwards. Said wall, according to a further development of the invention, is positioned on a carrier of the contact carrier, which, at the same time, is the carrier of a battery. This produces a particularly simple design.

Further advantageous features are produced from the dependent Claims, the following description and the drawing.

Figure 1:
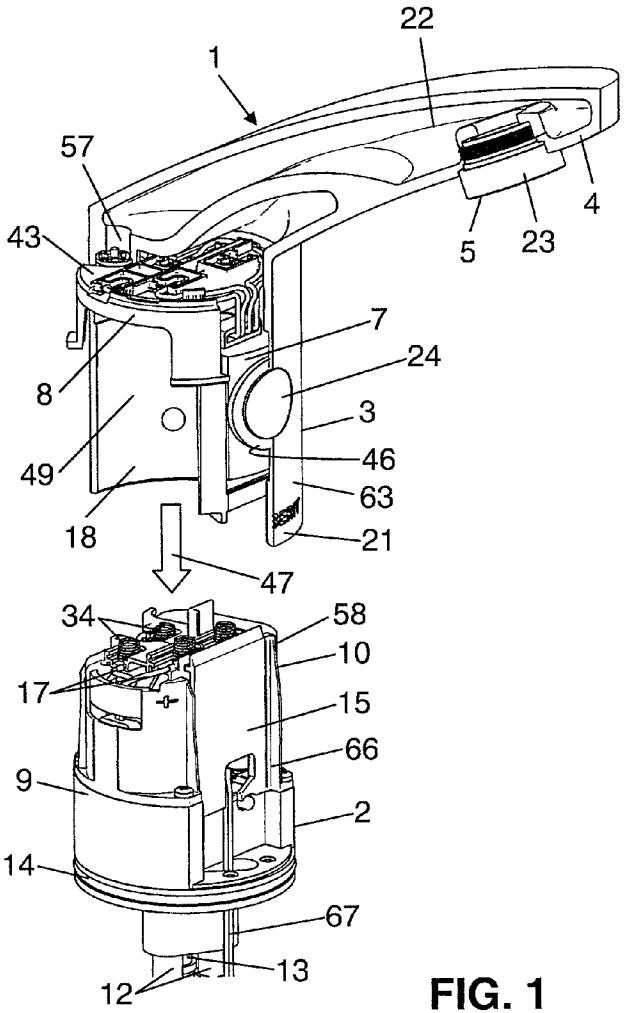
Figure 5:
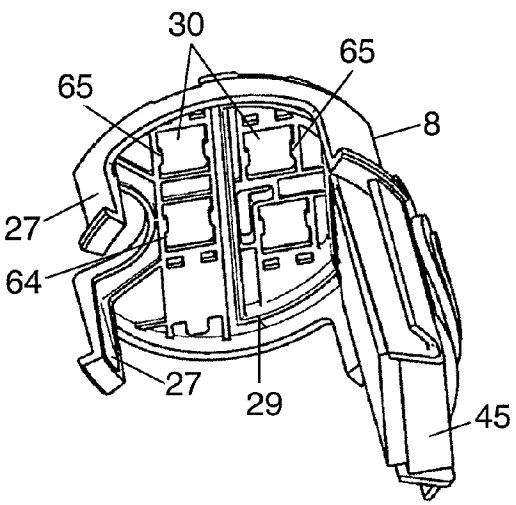
Figure 4:
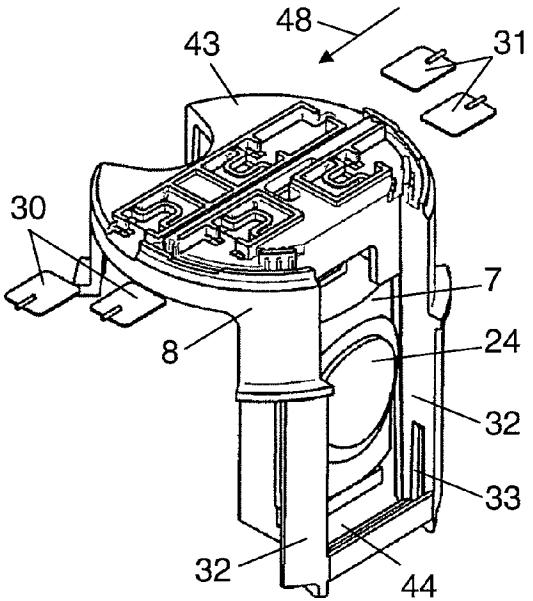
Figure 3:
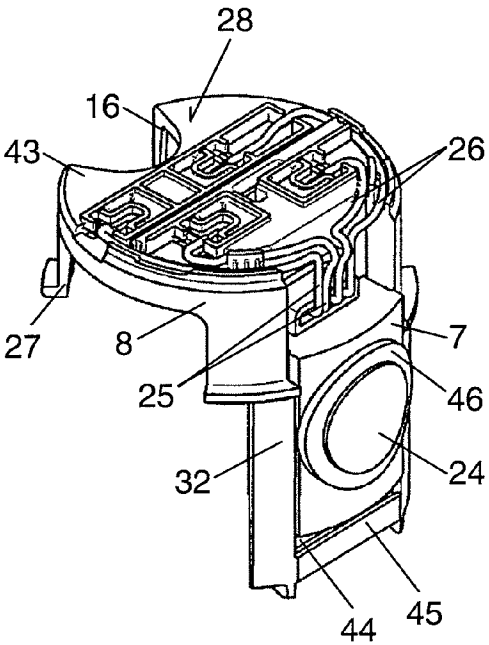
Figure 6:
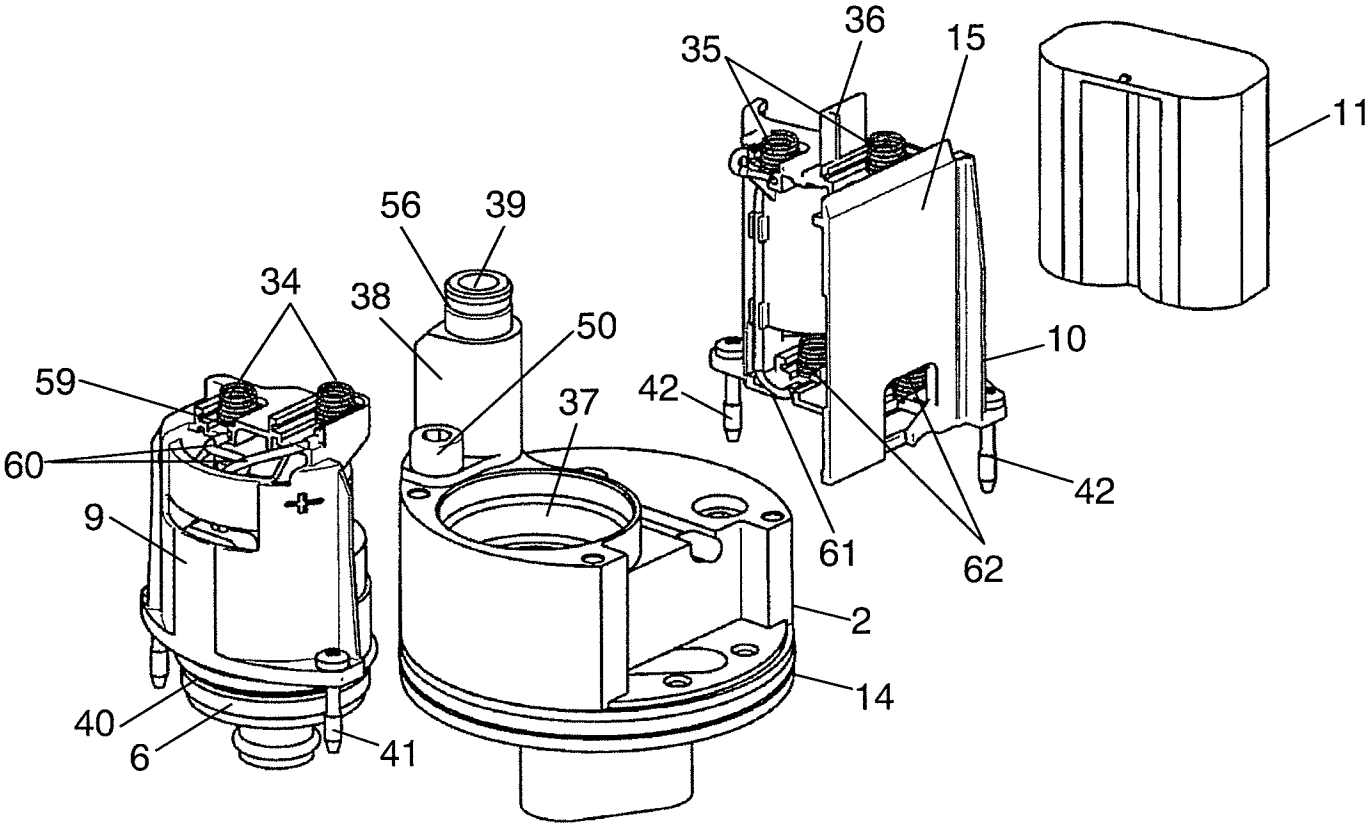

Exemplary embodiments of the invention are given below by way of the drawing, in which, in detail:

FIG. 1 shows a partial section of a perspective view of the faucet according to the invention, the base and the housing being separated for graphic reasons, FIG. 2 shows a perspective view of the partial section of the housing, the presence detector not yet being positioned in the holder, FIG. 3 shows a perspective view of the holder with the positioned presence detector, FIG. 4 shows a view of the holder to illustrate the mounting of contact plates, FIG. 5 shows a view of the underside of the holder and FIG. 6 shows a perspective view of the base and of the members positioned thereon, said members having been removed from the base for graphic reasons.

The faucet 1 has a base 2, which is securable in a known manner to a wash-stand or a building wall (not shown here). A securing screw 13 is provided, simply indicated in this case, for the securement from below into the base 2. The water is supplied by means of water pipes 12, which are also simply indicated. A manually operated mixing valve (not shown here) is positioned in the base 2. As can be seen in FIG. 6, a circular opening 37 is admitted into the base 2 and an electromagnetically operated valve 6 that has a sealing ring 40 is inserted into said opening. When the valve 6 is open, the pipes 12 are connected to a water channel 39 of a connector piece 38. The connector piece 38 is secured to the base 2 by means of a securing screw 50. The connector piece 38 extends with a connecting member 56 into a passage 57 of a housing 3, shown in FIG. 1, such that the water channel 39 is connected to a water channel 22 of the housing 3. In FIG. 1 an arrow 47 indicates the direction in which the housing 3 is mounted into position onto the base 2. At a bottom edge 21 the housing 3 is sealed relative to the base 2 by means of a sealing ring 14 positioned on the base 2. The water flowing into the water channel 22 passes through a water outlet opening 5 of a mouth piece 23 to the outside. Said mouth piece 23 is inserted into a protruding outlet member 4 of the housing 3.

A contact carrier 58 is placed on the base 2 as shown in FIG. 1, said contact carrier comprising a contact carrier member 9 and a contact carrier member 10 as shown in FIG. 6. The contact carrier member 9 is positioned at the valve 6 and is secured to the base 2 by means of two securing screws 41. Two contact springs are positioned on a topside 59 of the contact carrier member 9, said contact springs each being electrically connected to the valve 6 by means of a connecting line 60. As can be seen, the contact springs 34 protrude beyond the topside 59. They are preferably spiral springs, but can also be other suitable spring-resilient contacts. The contacts could also, for example, be in the form of spring-resilient tongues.

The contact carrier member 10 also has two contact springs 35 on the topside, it being possible for said contact springs to be identical to the contact springs 34. A battery 11 is mounted on the contact carrier member 10, said battery being connected to the contact springs 35 by means of contact springs 62 and lines 61 (only shown partially in this case). The contact carrier member 10 is also secured to the base 2 by means of two securing screws 42. A retaining rib 36, which is to prevent a short-circuit between the two contact springs 34 and 35, is positioned between the two contacts 35. In the mounted state, the contact springs 34 and 35 are positioned in one plane spaced apart from each other, as shown in FIG. 1.

The housing 3 has a receiving space 18 in a substantially circular cylindrical and downwardly open member 63, into which receiving space a holder 8 is inserted from below. The holder 8 has a substantially circular plate 43, on which a plurality of spring arms are integrally moulded, by means of which spring arms the holder 8 is locked to a shoulder 64 shown in FIG. 2. Two downwardly extending webs 32 are integrally formed on the plate 43, said webs being interconnected at a bottom end by means of a cross bar 45. The two webs 32 and 45 form an opening into which, from the inside, a presence detector 7 is inserted and secured to locking ribs 33, which are each integrally moulded on the inside of a web 32. The presence detector 7 has, for example, an infrared sensor, known in itself, with a window 24 that is, for example, circular. The plate 43, as shown in FIG. 3, has a lateral recess 16 for the passage of the connector piece 38.

The presence detector 7 has a control means that is not shown here but is known in itself. Said control means is connected on one side to two contact plates 30 by means of two connecting cables 25 and to two contact plates 31 by means of two electric connecting cables 26. Said contact plates 30 and 31 are each inserted, for example locked, into a recess 65 of the plate 43, shown in FIG. 5. FIG. 4 indicates, by means of an arrow 48, the direction in which the contact plates 31 are inserted.

On a topside 28 of the plate 43, each of the contact plates 30 and 31 are electrically connected in each case to one of the lines 25 and 26. The contact plates 30 and 31 are electrically contactable on an underside 29 of the plate 43. Said contact plates 30 and 31 are positioned such that, with the housing 3 placed in position, in each case one of the contact springs 34 and 35 is tensioned against one of the contact plates and 31 and contacts the same electrically. The presence detector 7 is then connected to the battery 11 by means of the two contact plates 31 and the contact between the presence detector 7 and the valve 6 is ensured by means of the contact plate 30. A connection to a network is also possible by means of connecting cable 67 for the power supply. If the housing 3 is removed from the base 2, the contacts of the contact springs 34 and 35 to the contact plates 30 and 31 are immediately lifted. The interruption in the electrical connection between the valve 6 and the presence detector 7 results in the valve 6 being immediately closed, should it be open.

The housing 3 can consequently be removed from the base 2 together with the holder 8 and the presence detector 7 and consequently be separated. The named electrical contacts are also broken in this case. The valve 6 and the battery 11 remain in the base 2 in this case. The holder 8 and the presence detector 7 are still mounted in the housing 3 after separation. The window 24 of the presence detector 7 is situated, in this case, in the circular opening 20 of the sleeve-shaped member 63, shown in FIG. 2. The presence detector 7 is sealed relative to said opening 20 by means of a ring-shaped seal 46. Once the housing 3 has been lifted from the base 2, the presence detector 7 can then be unlocked by hand by pressing onto the window 24 and moved radially inwards into the position shown in FIG. 2. The presence detector 7 is then still connected electrically and mechanically to the holder 8 by means of the connecting lines 25 and 26. By deflecting the spring arms 27 radially inwards, the locking of the holder 8 to the shoulder 64 of the housing 3 can be released and consequently the holder 8 can be removed from the receiving space 18 together with the presence detector 7.

In order to insert the holder 8 with the presence detector 7 back into the housing, the holder 8 is inserted from below into the receiving space 18 until the spring arms 27 lock onto the shoulder 64. The presence detector 7 is then inserted radially outwards into the opening 44 until the locking ribs 33 are locked in position. The rubber-resilient seal 46, in this case, is pressed against the member 63 on the inside of the circumference of the recess 20 such that, as already mentioned, the presence detector 7 is sealed off from the recess 20.

Once the presence detector 7 has been mounted, the housing 3 can be placed back into position on the base 2. In so doing, the named contacts are made and, by means of the sealing ring 14, the housing 3 is sealed on the bottom circumferential edge 21 relative to the base 2. The two webs 32 of the holder 8, in this case, are guided in a channel 66, which is shown in FIG. 1 and is open at the top and the front, said channel being formed by a wall 15 of the contact carrier member 10. The presence detector 7 slides along said wall 15 and is finally supported in an end position by said wall. This means that, in the mounted state, the presence detector 7 can consequently not be moved out of the intended position. The wall 15 supports the presence detector 7 such that the seal 46 is permanently pressed against the member 63 and consequently the named tightness is ensured. In the mounted state, the housing 3 can be secured by means of a screw (not shown here) which is inserted into an opening 49 of the member 63 (FIG. 1) and screw-connected to the base 2. Other connections are also conceivable here in place of a screw-connection.

| List of references |
|---|
| 1 Faucet |
| 2 Base |
| 3 Housing |
| 4 Outlet member |
| 5 Water outlet opening |
| 6 Valve |
| 7 Presence detector |
| 8 Holder |
| 9 Contact carrier member valve |
| 10 Contact carrier member battery |
| 11 Battery |
| 12 Water pipe |
| 13 Securing screw |
| 14 Sealing ring |
| 15 Wall |
| 16 Recess |
| 17 Connecting cable |
| 18 Receiving space |
| 19 Wall |
| 20 Recess |
| 21 Edge |
| 22 Water channel |
| 23 Mouth piece |
| 24 Window |
| 25 Connecting cable |

-continued

| List of references |
|---|
| 26 Connecting cable |
| 27 Spring arm |
| 28 Topside |
| 29 Underside |
| 30 Contact plate |
| 31 Contact plate |
| 32 Web |
| 33 Locking rib |
| 34 Contact spring |
| 35 Contact spring |
| 36 Retaining rib |
| 37 Opening |
| 38 Connector piece |
| 39 Water channel |
| 40 Sealing ring |
| 41 Securing screw |
| 42 Securing screw |
| 43 Plate |
| 44 Opening |
| 45 Cross bar |
| 46 Seal |
| 47 Arrow |
| 48 Arrow |
| 49 Opening |
| 50 Securing screw |
| 51 Connecting member |
| 56 Connecting member |
| 57 Passage |
| 58 Contact carrier |
| 59 Topside |
| 60 Connecting line |
| 61 Connecting line |
| 62 Contact springs |
| 63 Member |
| 64 Shoulder |
| 65 Recess |
| 66 Channel |
| 67 Connecting cable |

The invention claimed is:

1. A faucet controlled in a contactless manner, said faucet comprising a faucet body, which has a base that is securable to a wash-stand or a building wall and a housing that is detachably mounted on said base and has an outlet member with a water outlet opening, an electrically operated valve mounted on the base and a presence detector, said presence detector is mounted in a receiving space of the housing on a holder that has electrical contacts and said presence detector has a window, which is inserted into a recess of the housing, and the window is sealed off from said recess by means of a seal, wherein said holder is positioned so as to be mechanically and electrically detachable on a contact carrier and wherein said holder is locked to said housing in an interior of said receiving space into which said holder is positioned from below, wherein said contact carrier is secured to the base and has electrical contacts for establishing direct electrical contact with the electrical contacts of said holder, wherein the contact carrier comprises two contact carrier members, wherein the one member is connected electrically to the valve and the other member is connected electrically to the energy source, and wherein the housing with the holder and the presence detector is mechanically and electrically detachable and removable as a unit from the base with said contact carrier.

2. A faucet according to claim 1, wherein the holder has a plate, on which the electrical contacts are positioned, said plate has an underside, on which said electrical contacts are electrically connected to the electrical contacts of the contact carrier so as to be detachable.

3. A faucet according to claim 1, wherein two contacts for the electric contacting of an energy source and two contacts for controlling the valve are positioned on the holder.

4. A faucet according to claim 1, wherein the holder has an opening into which the presence detector is inserted from the receiving space radially outwards.

5. A faucet according to claim 4, wherein the presence detector is locked into the opening of the holder.

6. A faucet according to claim 1, wherein the presence detector is connected to the holder by means of connecting cables.

7. A faucet according to claim 1, wherein the electrical contacts of the contact carrier are formed by spring-resilient elements, which are each tensioned against a contact of the holder.

8. A faucet according to claim 7, wherein the spring-resilient elements are in the form of spiral springs.

9. A faucet according to claim 1, wherein the electrical contacts of the holder are plate-shaped.

10. A faucet according to claim 1, wherein the both contact carrier members are detachably secured on the base.

11. A faucet according to claim 1, wherein the contact carrier engages from below in the receiving space of the housing and supports the presence detector in said receiving space.

12. A faucet according to claim 11, wherein the contact carrier has a wall on which the presence detector is supported.

13. A faucet according to claim 12, wherein the wall is positioned on a contact carrier member on which an energy source is mounted.

14. Faucet according to claim 1, wherein said holder is locked by means of spring arms to said housing.

* * * * *